US006378598B1

(12) United States Patent
Tonelli et al.

(10) Patent No.: US 6,378,598 B1
(45) Date of Patent: Apr. 30, 2002

(54) PLATES FOR USE IN CONTINUOUS CASTING PROCESS FOR THE MANUFACTURE THEREOF

(75) Inventors: Riccardo Tonelli, Rome; Giuseppe Guasto, Genua, both of (IT)

(73) Assignees: Aociai Speciali Terni S.p.A., Terni (IT); Voest-Alpine Industrieanlagenbau GmbH, Linz (AT)

( * ) Notice: Subject to any disclaimer, the term of this patent is extended or adjusted under 35 U.S.C. 154(b) by 0 days.

(21) Appl. No.: 09/230,566

(22) PCT Filed: Jul. 30, 1997

(86) PCT No.: PCT/IT97/00195

§ 371 Date: Dec. 20, 1999

§ 102(e) Date: Dec. 20, 1999

(87) PCT Pub. No.: WO98/04369

PCT Pub. Date: Feb. 5, 1998

(30) Foreign Application Priority Data

Jul. 31, 1996 (IT) ..... RM96A0552

(51) Int. Cl.[7] ..... B22D 11/06; B28B 3/12

(52) U.S. Cl. ..... 164/428; 164/418; 164/480; 264/259; 264/260; 425/363; 428/67

(58) Field of Search ..... 264/259, 260; 164/428, 418, 480; 425/363; 428/67

(56) References Cited

U.S. PATENT DOCUMENTS 5,247,987 A * 9/1993 Tavernier et al. ..... 164/428
5,584,335 A * 12/1996 Barbe et al. ..... 164/428
6,082,437 A * 7/2000 Damasse et al. ..... 164/428
6,152,210 A * 11/2000 Baharis et al. ..... 164/502

OTHER PUBLICATIONS

Patent abstracts of Japan, vol. 095, No. 006, Jul. 31, 1995, JP 07 068352.

Patent abstracts of Japan, vol. 015, No. 318, Aug. 14, 1991, JP 03 118945.

Patent abstracts of Japan, vol. 015, No. 481, Dec. 6, 1991, JP 03 207554.

* cited by examiner

*Primary Examiner*—Christopher A. Fiorilla
(74) *Attorney, Agent, or Firm*—Browdy and Neimark

(57) ABSTRACT

The present invention provides an improvement to the plates for the side containing in apparatuses for the continuous casting of thin flat products, said plates comprising: at least one insert (8) of a ceramic material; a plurality of joints (11) for the thermal expansion, the joints being constituted of a ceramic fibers material; a first casting (9) of a silica-alumina material containing ceramic fibers; a second casting (10) of a silica-alumina material having a high content of $ZrO_2$; and a third casting (12) of a SiC-based thixotropic material; the arrangement being such that said at least a ceramic insert is arranged on said third casting (12) of a thixotropic material so that it assumes a substantially triangular shape, said first silica-alumina casting (9) based on a ceramic fibers material is arranged on said third casting (12) at the exterior area with respect to said at least a ceramic insert, said second casting (10) of silica-alumina material having a high contents of $ZrO_2$ is arranged on said third casting (12) of a thixotropic material substantially at the central portion of the plate defined by said at least a ceramic insert (8), and said plurality of joints (11) in ceramic fibers for the thermal expansion is arranged at the contacting surfaces between said at least a ceramic insert (8) and at least one of said first (9), second (10) and third casting (12).

8 Claims, 3 Drawing Sheets

PLATES FOR USE IN CONTINUOUS CASTING PROCESS FOR THE MANUFACTURE THEREOF

This application is a 371 of PCT/IT 97/0095 filed Jul. 30 1997.

DESCRIPTION

The present invention relates to an improvement in refractory plates for apparatuses for the continuous casting of flat, thin products and, more particularly to an improvement in refractory plates consisting in inserting thereon ceramic inserts against wear.

From JP-A-7068352 is disclosed a ceramic plate which is mounted on water cooled metallic case in order to make thermal deformation and side wear small in a casting twin rolls apparatus.

Refractory plates for the lateral containment of molten metal, in an apparatus for the continuous casting of thin, flat products and having ceramic inserts thereon are already known.

Presently, such plates are produced according to a known technique including the following steps:

casting a material having a high content of SiC;

creating areas destined for the containment of the inserts;

firing at a high temperature (1250° C.) of the plate thus obtained;

inserting, by means of a refractory cement having a high content of $ZrO_2$ (or SiC), the inserts of composite ceramic material (constituted, for example, of BN/Sialon or BN/SiC/$ZrO_2$);

casting a silica-alumina refractory material having a high content of $ZrO_2$ on the preformed plate of the previous casting; and firing at a low temperature (about 400° C.) of the plate so constituted.

Such technique for the production of refractory plates having ceramic material inserts, shows the disadvantage of being time-consuming and awkward. Moreover, it has the inconvenience of not allowing the achievement of plates with a good planarity caused by the fact that the inserts have level differences each other, even if these have a reduced value.

Another drawback of such technique consists in that, owing to the dimensional contraction of the casting and of the cement employed for the fastening of said inserts on the casting, some times there occur fissures between the inserts and adjacent parts of the plate. These fissures lead to possible infiltrations of molten metal with the consequent build-up of solid metal on the surface of the same. Such solid metal becomes the nucleus for the growth of solid steel crusts that endanger the whole casting process.

Thus, the aim of the present invention is to provide improved refractory plates having inserts of ceramic material that solve the abovementioned problems of reduced planarity, of a time-consuming and difficult production of the same, and of the generation of fissures in the areas between inserts and refractory castings.

Another aim of the present invention is to provide low-cost improved refractory plates with ceramic material inserts.

A further object of the present invention is to provide a process for the production of such improved refractory plates.

Therefore, according to the present invention, there are provided improved refractory plates for the lateral containment in apparatuses for the continuous casting, characterised in that they comprise:

at least one insert of a ceramic material;

a plurality of joints for the thermal expansion, the joints being constituted of a ceramic fibres material;

a first casting of a silica-alumina material containing ceramic fibres;

a second casting of a silica-alumina material having a high content of $ZrO_2$; and a third casting of a SiC-based thixotropic material;

the arrangement being such that said at least a ceramic insert is arranged on said third casting of a thixotropic material so that it assumes a substantially triangular shape, said first silica-alumina caseting based on a ceramic fibres material is arranged on said third casting at the exterior area with respect to said at least a ceramic insert, said second casting of silica-alumina material having a high contents of $ZrO_2$ is arranged on said third casting of a thixotropic material substantially at the central portion of the plate defined by said at least a ceramic insert, and said plurality of joints in ceramic fibres for the thermal expansion is arranged at the contacting surfaces between said at least a ceramic insert and at least one of said first, second and third casting.

Moreover, the present invention provides a process for the production of refractory plates with ceramic inserts, characterised in that it comprises the following steps:

positioning and optimised coupling, by means of gluing, of at least one insert of ceramic material on the bottom of a mould;

positioning with an optimised coupling of a plurality of joints constituted in ceramic fibres, on the peripheral walls of said at least one insert of ceramic material;

carrying out of a first casting of a refractory material, substantially constituted of a mixture of silica-alumina and ceramic fibres, at the external part of said at least one ceramic insert;

carrying out of a second casting of a silica-alumina refractory material having a high contents of $ZrO_2$, at the central part of the plate and internally bounded by said at least one ceramic insert;

carrying out of a third casting of a refractory thixotropic material with a high contents of SiC, above said at least one ceramic insert, with respect to said first casting of refractory material and said second casting of refractory material having a high contents of $ZrO_2$;

removing the plate thus constituted from said mould, after a time of at least 24 hours;

thermal treating the plate at 110° C. for a period of time of at least 24 hours; and firing at low temperature said plate at least at 400° C. for a time period of at least 1 hour.

The present invention will be now better shown by the disclosure of a preferred embodiment thereof, given as an exemplary and non-limitative embodiment, with reference to the attached drawings, wherein.

Figure 1:
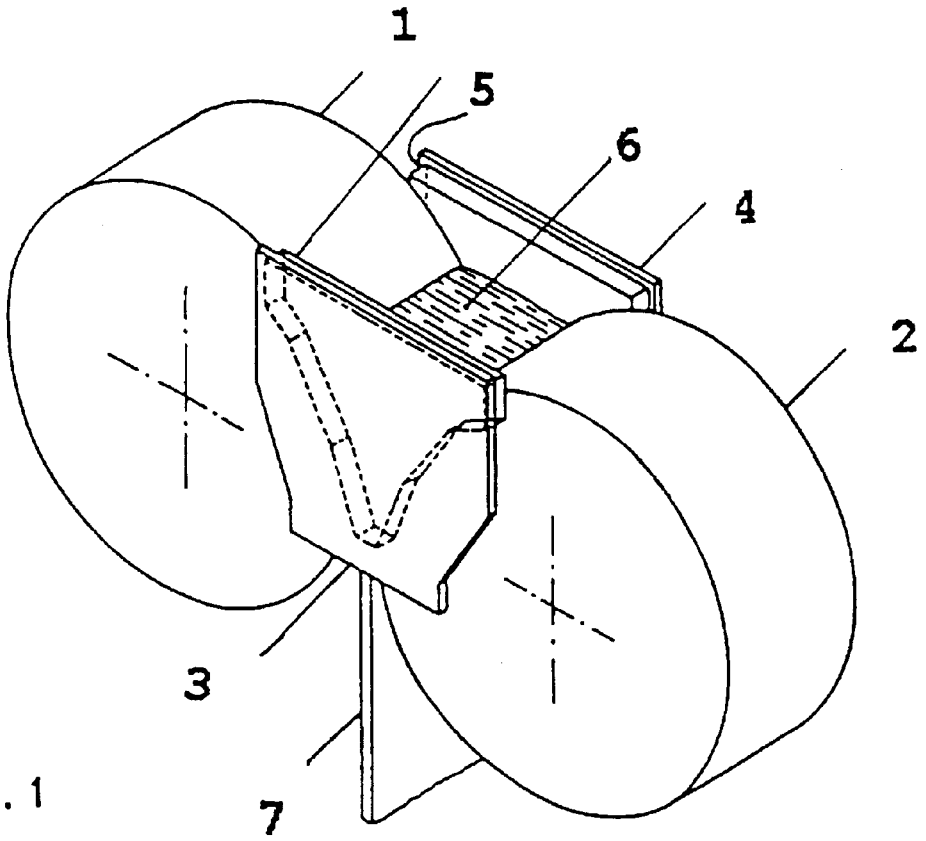
FIG. 1 is a perspective view that shows schematically an apparatus for the continuous casting of thin, flat products, according to the present invention.

With reference now to FIG. 1, it shows schematically an apparatus for the continuous casting of flat, thin products.

Conventionally, the apparatus comprises a pair of counter-rotating rolls 1 and 2, and with their rotation axes spaced by a distance greater than the sum of their radiuses. At both the lateral faces of said rolls 1 and 2 there are arranged two flat walls 3 and 4 which have respective refractory plates 5 (better shown hereinafter) for the lateral containment of molten metal 6 cast between the rolls 1 and 2. The arrangement is such to obtain a flat product 7 following the rotation of the rolls 1 and 2.

Figure 2:
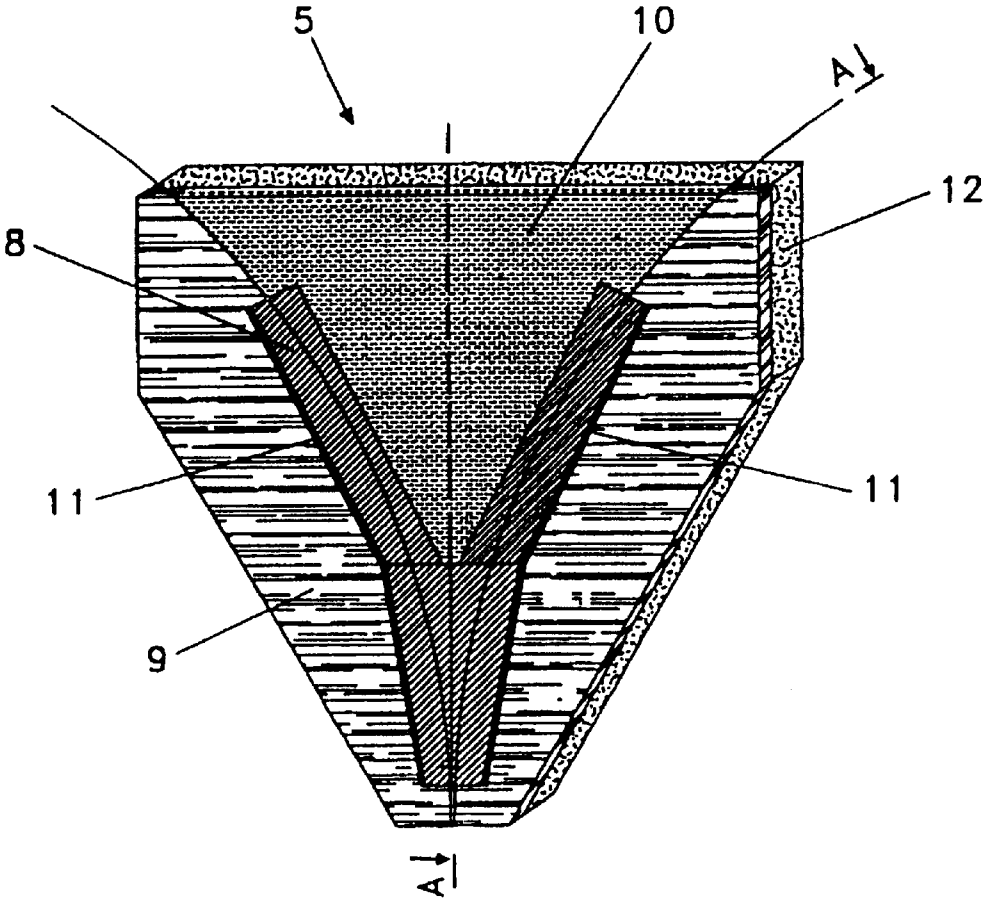
FIG. 2 is a perspective view that shows partially a first embodiment of the plate, according to the invention.

With reference now to FIG. 2, it shows a perspective view that illustrates partially the plate according to the invention.

The plate 5 is constituted of a plurality of inserts 8 of a ceramic material arranged along the contacting arc between the edges of the rolls 1, 2 (schematically shown by means of the lines A—A) and the surface of the plate. The arrangement of the inserts 8 is such so that they assume a "Y"-shape on the plate 5.

At the side portion of the plate and externally to the inserts 8, a first casting 9 of a silica-alumina refractory material containing ceramic fibres is provided. Such a compound has an extremely low thermal conductivity, avoiding thus the dispersion of heat towards the exterior.

On the other hand, at the upper central portion of the plate, bounded peripherally by the inserts 8, there is obtained a second casting 10 of a silica-alumina refractory material having a high contents of Zirconia ($ZrO_2$), that has a high resistance to the chemical attack of the molten metal and a low wettability and, obviously, a high degree of refractoriness.

At the peripheral surfaces of said inserts 8, there are arranged joints 11 for the thermal expansion (having the shape of elongated elements) constituted of highly refractory ceramic fibres, arranged for compensating the different thermal expansion between the inserts 8 and the adjacent castings 9 and 10, respectively, thus avoiding the formation of possible spaces or fissures that might constitute nuclei of cooled metal, with the consequences disclosed hereinabove.

On the back of the inserts 8 and the castings 9 and 10, is provided a third casting 12 of a thixotropic material having a high contents of SiC, providing the support for the abovementioned inserts 8 and the castings 9 and 10, respectively by covering them on their back and entirely. Said casting 12 of a thixotropic material has a high thermal conductivity and high mechanical characteristics.

Figure 3:
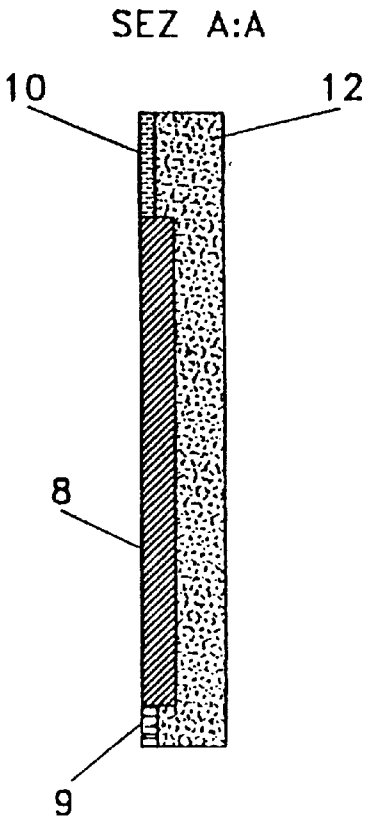
FIG. 3 is a cross sectional view of the plate of FIG. 2, taken along line A—A.

With reference to FIG. 3, it shows a cross section of the plate, taken along the line A—A of FIG. 2.

As one can see, the third casting 12 of material having a high contents of SiC, constitutes the support both for the inserts 8 and for the castings 9 and 10, respectively.

Figure 5:
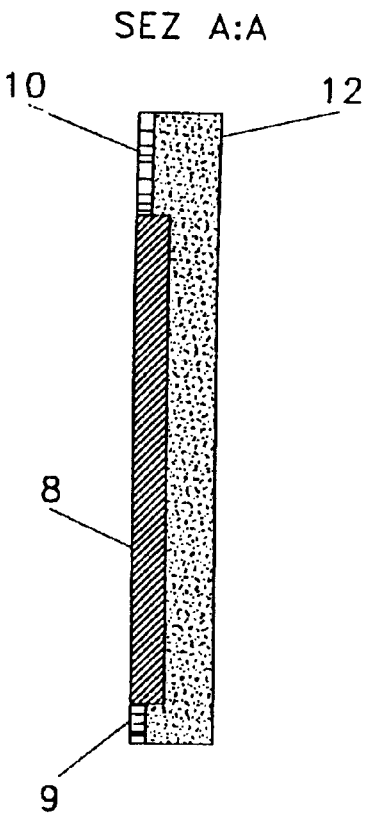
FIG. 5 is a cross sectional view of the plate of FIG. 4, taken along line A—A.
Figure 4:
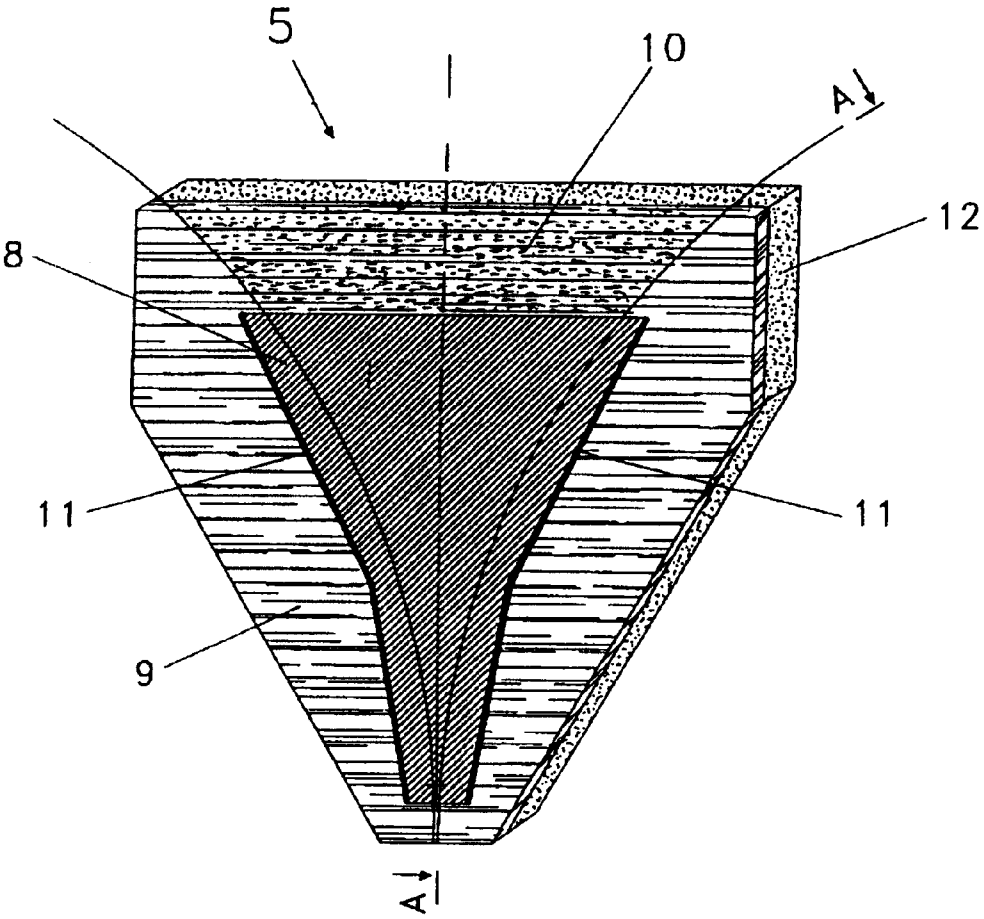
FIG. 4 is a perspective view that shows partially a second embodiment of the plate according to the invention.

With reference now to FIGS. 4 and 5, they show a perspective view a cross sectional view along the line A—A, respectively, of a second embodiment of the present invention.

For sake of simplicity, the disclosure of parts having the same reference numerals of the former embodiment will be omitted because of the same constitution and, therefore, already previously described.

As it is clear, in this embodiment, the plate has a single insert 8 in a ceramic material and in the shape of substantially a triangle.

Herebelow two examples will be given of the embodiments of a plate, according to the present invention.

EXAMPLE 1

Refractory plates have been obtained by means of a casting material and inserts in a ceramic material, having the following features: a)Inserts constituted of a ceramic composite material. The ceramic inserts have the following composition, expressed in percentage in weight with respect to the total weight of the mixture:

$ZrO_2$ 50%

BN 45%

SiC 5% b) First casting of a silica-alumina refractory material constituted of ceramic fibres. A material has been utilised substantially constituted of the following compounds, expressed in percentage in weight with respect to the total weight of the mixture:

$Al_2O_3$ 45%

$SiO_2$ 33%

$Fe_2O_3$ 3,5% resulting in a material with the following features:

refractoriness $\leqq$1300° C.

thermal conductivity at 1000° C.$\leqq$0,23 W/m K c) Second casting of a silica-alumina material having a high contents of Zirconia. A material with a high contents of Zirconia has been utilised, substantially constituted of the following compounds, expressed in percentage in weight with respect to the total weight of the mixture:

$ZrO_2$ 43%

$Al_2O_3$ 28%

$SiO_2$ 24%

Thus, it was obtained a material with a refractoriness higher than 1650° C. and with an excellent resistance to the chemical attack by the molten metal and a low wettability.

d) Third casting of a refractory material with a high contents of SiC. It was utilized a material with a high contents of SiC and substantially constituted of the following compounds, expressed as a percentage in weight with respect to the total weight of the mixture:

$Al_2O_3$ 8.5%

$SiO_2$ 4.5%

SiC 85%

Thus, a material with the following characteristics has been obtained:

refractoriness >1600° C.

thermal conductivity at 1000° C. >5 W/m K tensile strength $\geqq$800 kg/cm$^2$.

Moreover, joints for the thermal expansion have been inserted between the inserts and the castings, constituted essentially of the following compound, expressed as a percentage in weight with respect to the total weight of the mixture:

$Al_2O_3$85%

$SiO_2$ 5%

EXAMPLE 2

Refractory plates have been obtained by casting a refractory material constituted as in the former example and inserts of a ceramic material, the inserts having the following composition, expressed in percentage in weight with respect to the total weight of the mixture:

Sialon (Oxynitride of silicon and aluminium) 70%.

Consequently, with the plates constituted according to the above examples, several castings of INOX™ 304 steel have been accomplished, and more than 1000 m of a thin band having a thickness of 2.5 mm and width of 800 mm were achieved. Furthermore, the wear detected of the ceramic inserts has been lower than 3 mm/km.

Work tests confirmed the effectiveness of the new assembly that has given origin to neglectable undesired solidifications.

As a matter of fact, with respect to the embodiments of plates according to the prior art, in which the sliding inserts are bound with a refractory cement to the underlying plate, the present embodiment allows to obtain a monolithic composite plate in which all the components are assembled each other with continuity thanks to the formation of chemical bonds having high mechanical characteristics. In this way there is avoided the possibility of occurring fissures between a material and another, as in the case of a refractory cement and, consequently, the problems which cause undesired solidifications which would entail the inconvenience that have been disclosed hereinbefore.

What is claimed is:

1. A plate (5) for lateral containment in apparatus for continuous casting, comprising:

at least one insert (8) of a ceramic material;

a plurality of joints (11) for thermal expansion, the plurality of joints being constituted of a ceramic fibrous material;

a first casting (9) of a silica-alumina material containing ceramic fibres;

a second casting (10) of a silica-alumina material having a high content of $ZrO_2$; and a third casting (12) of a SiC-based thixotropic material;

the arrangement being such that said at least one ceramic insert (8) is arranged on said third casting (12) of a thixotropic material so that it assumes a substantially triangular shape, said first casting (9) is arranged on said third casting (12) at an exterior area with respect to said at least a ceramic insert (8), said second casting (10) of silica-alumina material having a high content of $ZrO_2$ is arranged on said third casting (12) of a thixotropic material substantially at a central portion of the plate (5) defined by said at least one ceramic insert (8), said third casting (12) entirely covers said first and second castings (9, 10) on their back sides, and said plurality of joints (11) of ceramic fibres for the thermal expansion is arranged at contacting surfaces between said at least one ceramic insert (8) and at least one of said first, second and third casting (9, 10, 12).

2. A plate according to claim 1, wherein said third casting (12) of SiC-based thixotropic material includes a mixture of the following components, expressed in percent by weight:

$Al_2O_3$ 5 to 15%

$SiO_2$ 2 to 4.5%

SiC 80 to 95%;

the remaining to 100 being substantially impurities.

3. A plate according to claim 1, wherein said second casting (10) of a silica-alumina material having a high contents of $ZrO_2$ includes a mixture of the following compounds, expressed in percent by weight:

$ZrO_2$ 40 to 60%

$Al_2O_3$ 25 to 40%

$SiO_2$ 15 to 40%;

the remaining to 100 being substantially impurities.

4. A plate according to claim 1, wherein said first casting (9) based on ceramic fibres includes a mix of the following compounds, expressed as a percent by weight:

$Al_2O3$ 40 to 50%

$SiO_2$ 30 to 40%

$Fe_2O_2$ 2.5 to 4.5%;

the remaining to 100 being substantially impurities.

5. A plate according to claim 1, wherein each insert (8) of said plurality of ceramic inserts, includes a mixture of the following compounds, expressed in percentage in weight with respect to the total weight of the mixture:

BN 20 to 55%; and at least one among the following compounds:

$ZrO_2$ 40 to 60%

SiC 2.5 to 7.5%;

Sialon (Silicon and aluminium oxinitride) 55 to 90% the remaining to 100 being substantially impurities.

6. A plate according to claim 1, wherein said plurality of joints (11) of ceramic fibres for the thermal expansion comprises a mixture of the following compounds, expressed in percentage by weight:

$Al_2O_2$ 80 to 85%

SiC 2 to 25% the remaining to 100 being substantially impurities.

7. A process for the manufacture of improved refractory plates (5) with at least one ceramic insert (8) according to claim 1, characterised in that it comprises the following steps:

positioning and optimized coupling, by gluing, at least one insert (8) of ceramic material on the bottom of a mould;

positioning with an optimized coupling a plurality of joints (11) constituted of ceramic fibre, on peripheral walls of said at least one insert (8) of ceramic material;

carrying out a first casting (9) of a refractory material, substantially constituted of a mixture of silica-alumina and ceramic fibres, at an external part of said at least one ceramic insert (8);

carrying out a second casting (10) of a silica-alumina refractory material having a high contents of $ZrO_2$, at the central part of the plate (5) and internally bounded by said at least one ceramic insert (8);

carrying out a third casting (12) of a refractory thixotropic material with a high contents of SiC, above said at least one ceramic insert (8), with respect to said first casting (9) of refractory material and said second casting (10) of refractory material having a high contents of $ZrO_2$, whereby said first and second castings (9, 10) are entirely covered on their back sides;

removing the plate (5) thus constituted from said mould, after a time of at least 24 hours;

thermal treating the plate (5) at 110° C. for a period of time of at least 24 hours; and firing at low temperature said plate (5) at least at 400° C. for a time period of at least 1 hour.

8. An apparatus for the continuous casting of flat, thin bodies (7), comprising:

at least a pair of counter-rotating rolls (1, 2) having their longitudinal axes arranged parallel at a distance greater than the sum of their radiuses; and at least a pair of refractory plates (5) for the containment of molten metal (6), positioned at the bases of said pair of rolls (1, 2);

the plates (5) being characterized in that they comprise:

at least one insert (8) of a ceramic material;

a plurality of joints (11) for thermal expansion and formed of a ceramic fibrous material;

a first casting (9) of a silica-alumina material comprising ceramic fibres;

a second casting (10) of a silica-alumina material having a high content of $ZrO_2$; and a third casting (12) of a SiC-based thixotropic material;

whereby said at least one ceramic insert (8) is arranged on said third casting (12) of thixotropic material in such a way to form a substantially triangular shape, said first silica-alumina casting (9) with ceramic fibres is arranged on said third casting (12) at an external area with respect to said at least one ceramic insert (8), said second casting (10) of material having a high contents of $ZrO_2$ is arranged on said third casting (12) of thixotropic material substantially at a central area defined by said at least one ceramic insert (8), said third casting (12) entirely covers said first and second castings (9, 10) on their back sides, and said plurality of joints (11) of ceramic fibres is arranged at contact surfaces between said at least one ceramic insert (8) and at least one of one of said first, second and third casting (9, 10, 12).

* * * * *